US006036289A

United States Patent [19]

Marcoux

[11] Patent Number: 6,036,289

[45] Date of Patent: Mar. 14, 2000

[54] FOLDABLE ARTIST EASEL

[76] Inventor: Yolande Marcoux, 48 Bernard, R.R. #5, Canton Magog, Québec, Canada, J1X 3W5

[21] Appl. No.: 09/186,654

[22] Filed: Nov. 6, 1998

[51] Int. Cl.[7] ..... A47B 27/00

[52] U.S. Cl. ..... 312/231; 312/258

[58] Field of Search ..... 312/231, 233, 312/237, 240, 244, 258; 248/441.1, 460; 40/733, 605, 610

[56] References Cited

U.S. PATENT DOCUMENTS

| | | | |
|---|---|---|---|
| 1,854,721 | 4/1932 | Swain | 312/233 X |
| 2,503,807 | 4/1950 | Dolas | 312/231 |
| 2,751,271 | 6/1956 | Dessertenne et al. | 312/231 |
| 3,165,367 | 1/1965 | Rose . | |
| 3,202,471 | 8/1965 | Wilson . | |
| 3,304,045 | 2/1967 | Bethoney . | |
| 3,360,319 | 12/1967 | Hocking . | |
| 3,368,786 | 2/1968 | Bulman . | |
| 3,463,218 | 8/1969 | Cannon et al. | 40/605 X |
| 3,466,777 | 9/1969 | Wistrand et al. | 40/605 |
| 3,476,456 | 11/1969 | Canavan . | |
| 3,514,173 | 5/1970 | Ford . | |
| 3,630,588 | 12/1971 | Baker | 312/231 |
| 3,685,666 | 8/1972 | Rose | 40/605 X |
| 4,214,392 | 7/1980 | Virsen | 40/733 X |
| 4,317,606 | 3/1982 | Hastings | 312/231 |
| 4,856,749 | 8/1989 | Habermann | 248/460 X |
| 4,977,696 | 12/1990 | Johansson | 40/605 |

FOREIGN PATENT DOCUMENTS 2311933 10/1997 United Kingdom .

*Primary Examiner*—Peter R. Brown
*Assistant Examiner*—James O. Hansen
*Attorney, Agent, or Firm*—Mario D. Theriault

[57] ABSTRACT

An easel has generous shelf area disposed into a U-shaped workshop environment. The easel has a lower structure made of a central frame and lateral left and right frames hingedly connected to the central frame. Each of the central and lateral frames has one or more shelves set therein. The shelves are at arm's length to an artist standing or sitting within the workshop environment. The easel also comprises a work support structure connected to the top member of the central frame. Handrails are provided along the top edge of each frame and a footrest is mounted across a lower portion of each frame. These handrails and footrests are accessible to a user of the easel for bracing himself/herself when leaning forward toward a canvas or when moving into similar out of balance stances.

20 Claims, 4 Drawing Sheets

FOLDABLE ARTIST EASEL

FIELD OF THE INVENTION

The present invention relates to easels used by artists for painting, and more particularly, the invention pertains to an easel having a foldable U-shaped structure that incorporates handrails, footrests and shelves that are arranged to form a practical, safe and efficient workshop environment.

BACKGROUND OF THE INVENTION

Artistic work and painting in particular, is often carried out in the outdoors while in sight of an inspiring scenery. In other instances, the artist must paint in an area that is not always suited for this purpose, such as a corner of the kitchen or living room for example. Therefore, a primary requirement for an artist easel is believed to be that the apparatus must be foldable and easily transportable inside a house and outdoors.

In another aspect, painting artists generally require a large number of brushes, spatulas, pencils, paint supplies, solvents, towels and other material. It is preferable that these tools, supplies and accessories be deployed over a relatively large surface such that they are not piled over one another, are easy to find and stay relatively clean. It is believed that an ideal easel must also be adapted to support a large number of deployed tools and accessories.

As can be appreciated, painting art may be at times tedious where one has to hold a palette in one hand and a brush in the other hand and perform in a highly concentrated state for extended periods of time, for doing delicate details on a painting for example. Such postures, when kept for long periods are known to cause arm, shoulder and back strains. Therefore, a third requirement for an artist easel is believed to be that the structure thereof should provide arm support to periodically allow a user to rest his/her arms, or to otherwise lay down his/her palette once in a while. It is further believed that an easel should incorporate a handrail on which an artist can place his/her hand when leaning forward close to a painting, such that the strain of the posture is not entirely applied on his/her back.

Furthermore, an artist often sits on a stool, or alternately sits and stands while using an easel. Although this is generally more appropriate than always standing up, it can cause an out of balance condition when one tries to lean forward toward the canvas for example while sitting. Therefore, it is believed that a fourth requirement for an artist easel is that there should be provided one or more footrests to brace a user's foot and stabilize a posture of an artist in a sit position, and to allow an artist to take a standing posture in which he/she can best assure an ideal brush stroke.

It is believed that while some of the easels of the prior art are foldable and provide substantial work area, these easels generally, are lacking a structure capable of relieving arm, shoulder and back strains associated with the use of an easel.

In that respect, a representative group of easels of the prior art is presented hereinbelow.

In a first example, the U.S. Pat. No. 3,165,367 issued on Jan. 12, 1965 to Herman Rose, illustrates an artist easel that can be folded into a tow cart for transportation between outdoor sites. The cart has various compartments for transporting paint supplies and several canvases.

In a second example, the U.S. Pat. No. 3,202,471 issued on Aug. 24, 1965 to Quitman L. Wilson discloses a combined box, easel and table. The device has telescoping legs and retractable trays and drawers, and is foldable into a compact carrying-case arrangement.

U.S. Pat. No. 3,304,045 issued on Feb. 14, 1967 to J. J. Bethoney discloses an easel of the traditional A-frame type. The easel of this invention is particularly easy to fold down into a package of small size for convenient transportation.

Another artist stand is described in U.S. Pat. No. 3,360,319 issued on Dec. 26, 1967 to W. R. Hocking. This invention has the form of a stand with a rectangular upper work surface disposed at about waist height. The stand is supported on four legs and a storage compartment is formed below the work surface. The two rear legs carry wheels for transporting the stand from place to place.

Other artist easels of the prior alt are described in the following U.S. Patents. All these devices are characterized by the fact that the work surface available to the artist to deploy his/her tools is relatively small and concentrated in one location, that is in the front or alongside a user.

U.S. Pat. No. 3,368,786 issued on Feb. 13, 1968 to O. Bulman;

U.S. Pat. No. 3,476,456 issued on Nov. 4, 1969 to D. M. Canavan;

U.S. Pat. No. 3,514,173 issued on May 26, 1970 to T. E. Ford;

As can be appreciated, the structures of artist easels of the prior all lack the essential elements pertaining to the ergonomics associated with a use thereof. Therefore, it is believed that a need exists for an easel that has structural features which make it safe for use by individuals having different postural preferences, and which simultaneously provide to users a practical workshop environment and space efficiency.

SUMMARY OF THE INVENTION

In the present invention, however, there is provided an easel that has generous shelf area disposed to form a U-shaped workshop environment. The shelves of the easel of the present invention are at arm's length to an artist standing or sitting within the workshop environment, and are movable to accommodate the handedness and preferences of most painting artists.

In a first aspect of the present invention, there is provided a foldable easel comprising a lower structure made of a central frame and lateral left and right frames. One of the side edges on each lateral frame is hingedly connected to a respective side members on the central frame such that the lateral frames are foldable from a stowable position with the planes thereof being laid against the central frame, to a deployed position forming with the central frame a substantially U-shape configuration. Each of the central and lateral frames has one or more shelves set therein. The easel of the present invention also comprises a work support structure connected to the top member of the central frame. This work support structure has channel members for supporting a canvas in a secured relationship therewith.

A first advantage of the easel of the present invention is that when the central frame and the lateral frames are adapted to be set in an upright orientation and the lateral frames are set in a deployed mode relative to the central frame, the lower structure is free standing and adaptable to the obstructions on a terrain. Other notable advantages of the easel of the present invention comprises the fact that the U-shaped arrangement of the frames provides a workshop environment which partly encloses a user of the easel and constitutes an efficient utilization of space. An artist using the easel of the present invention can find any of his/her tools and accessories in a glance and take it in a stretch of the arm. When the easel is used indoors, it can be left in place as a small workshop until a painting is completed.

According to a second aspect of the present invention, there are provided a handrail extending along a top edge of each frame and a footrest mounted across a lower portion of each frame. These handrails and footrests are accessible to a user of the easel for bracing himself/herself when leaning forward toward a canvas and when moving into similar out of balance stances. The handrails are also usable for relaxing one's arms between painting sessions. Therefore these handrails and footrests provide a safe working environment for preventing shoulder and back pains associated with intensive painting on a canvas.

BRIEF DESCRIPTION OF THE DRAWINGS

The preferred embodiment of the present invention will be further understood from the following description, with reference to the drawings in which like numerals denote like parts throughout the several views, and in which.

DETAILED DESCRIPTION OF THE PREFERRED EMBODIMENT

Figure 1:
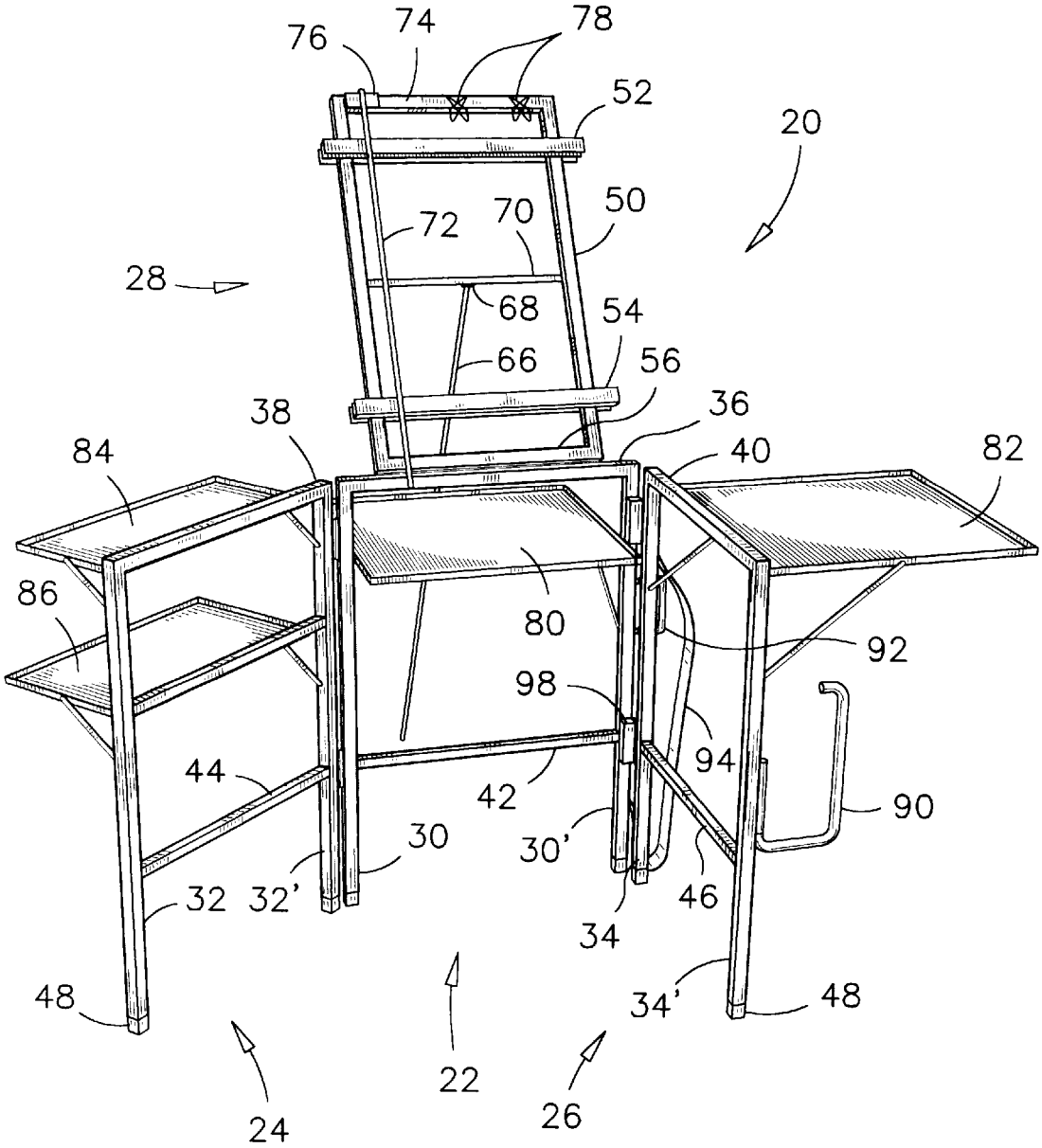
FIG. 1 is a front perspective view of the easel according to a preferred embodiment of the invention, shown in a fully deployed mode.

While this invention is susceptible of embodiment in many different forms, there is shown in the drawings and will be described in details herein a specific embodiment, with the understanding that the present disclosure is to be considered as an example of the principles of the invention and is not intended to limit the invention to the embodiment illustrated.

Furthermore, the easel of the preferred embodiment is convenient for use by painting artists, by caricaturists, by other persons applying their drafting skills, by teachers using visual displays, and by lecturers making presentations using visual displays and a number of accessories. Although the easel is convenient for use by a large number of professionals, the easel of the preferred embodiment is referred to herein as an easel for the painting artist, for the convenience of this disclosure. Those skilled in the art will appreciate that the needs and work postures of the painting artist are not so different from those of the lecturer or teacher and that the easel according to the preferred embodiment is usable by other professionals without major modification from the arrangement of the preferred embodiment described herein.

Figure 2:
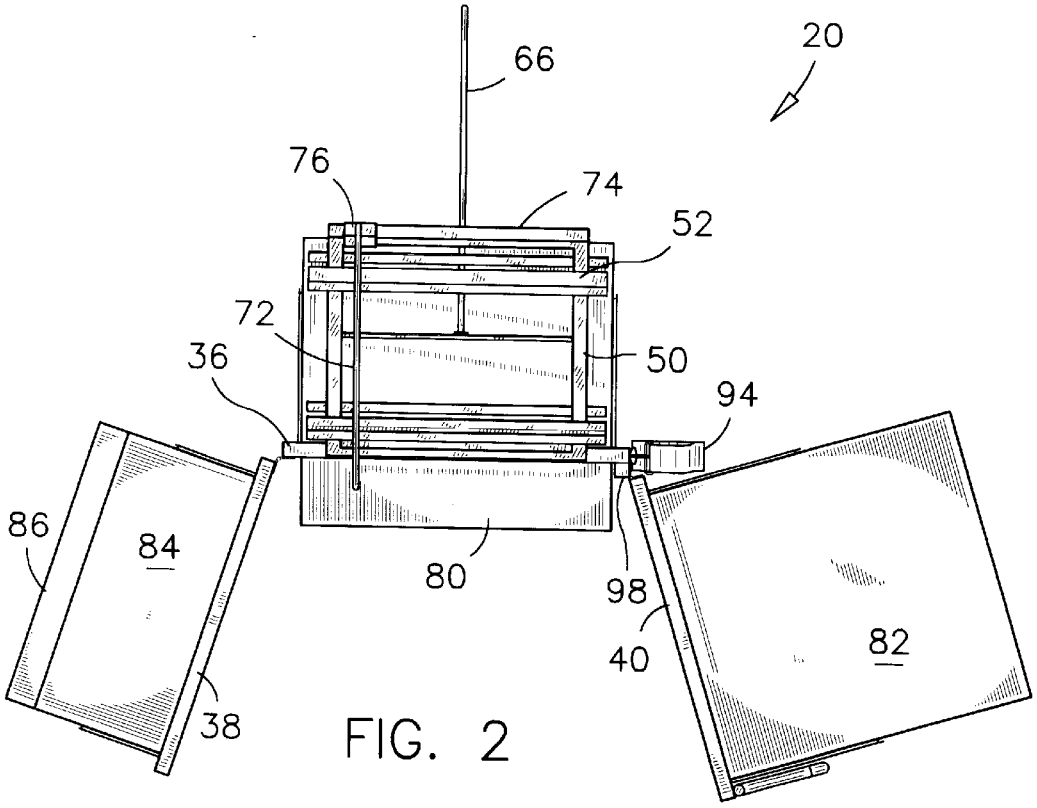
FIG. 2 is a top plan view of the easel of the preferred embodiment in a fully deployed mode.
Figure 3:
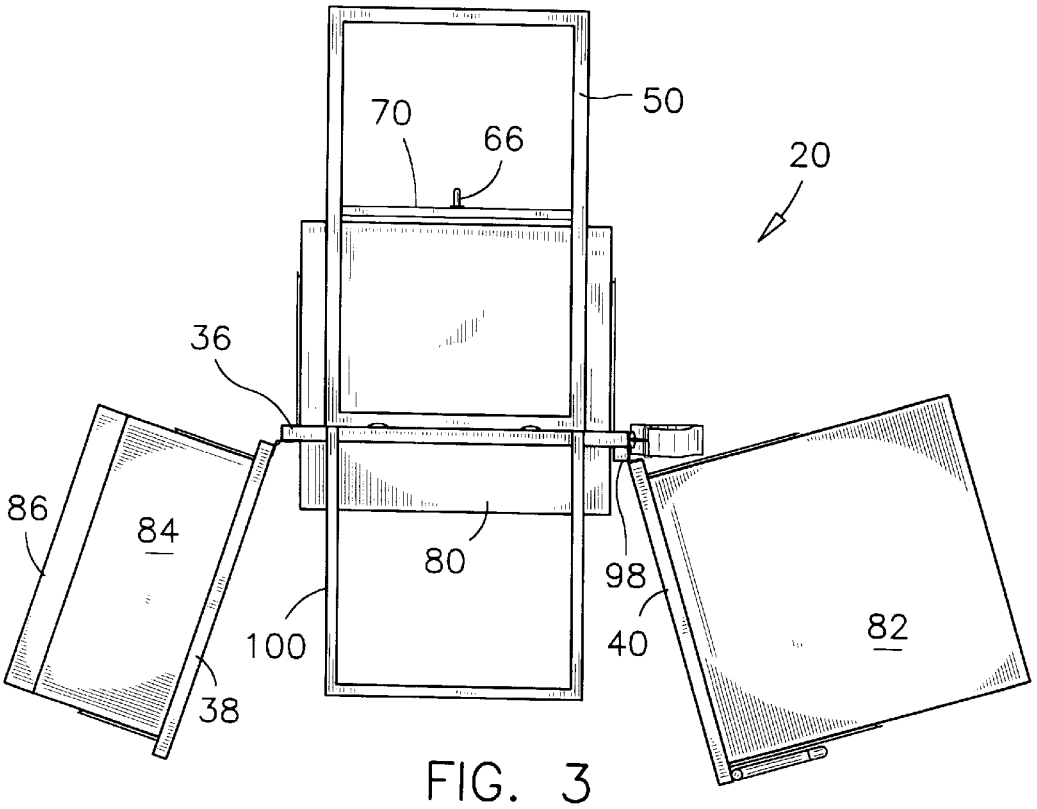
FIG. 3 is another plan view of the easel in a fully deployed mode, with the work support frame laying horizontally.
Figure 4:
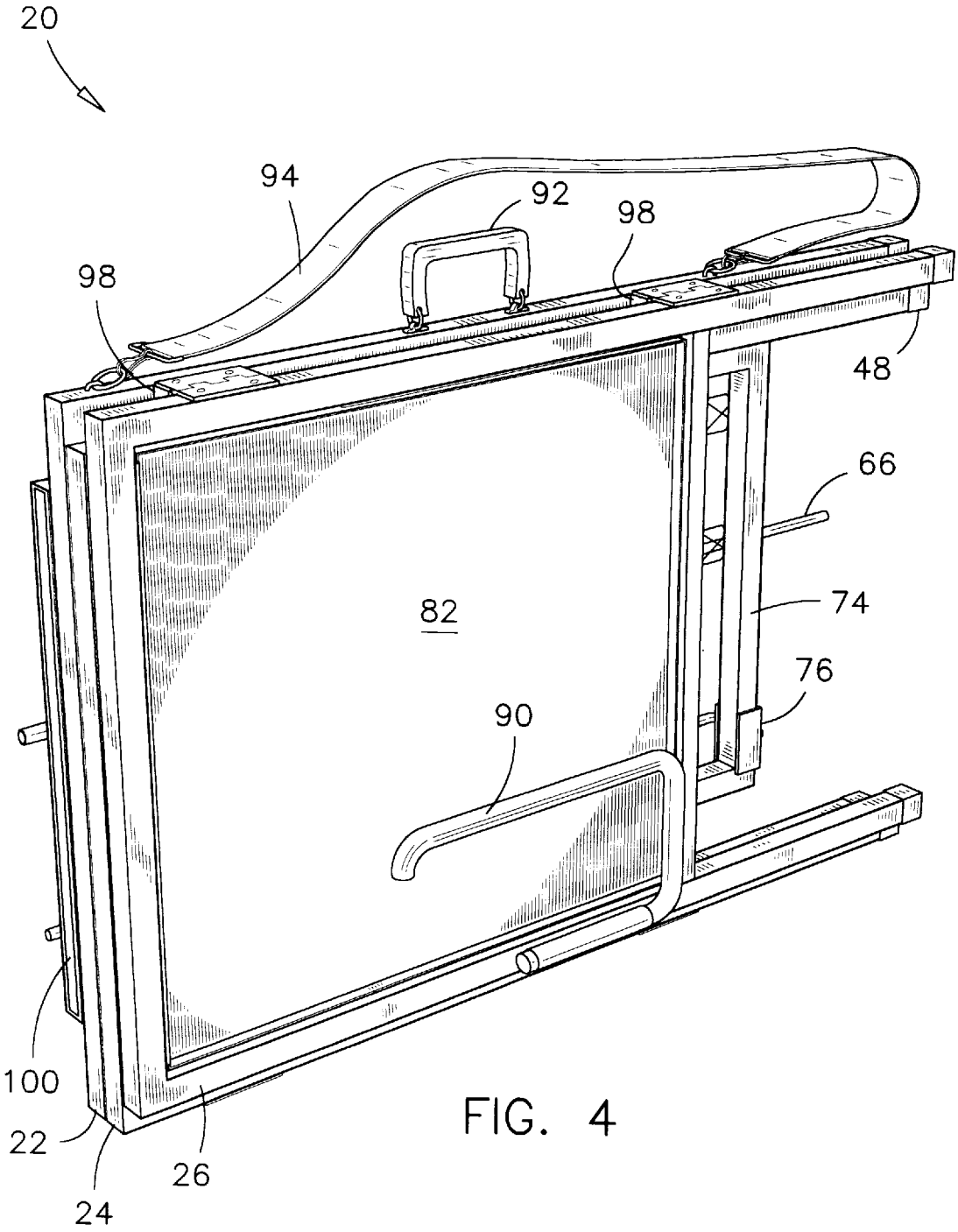
FIG. 4 is first side perspective view of the easel in a folded mode.
Figure 5:
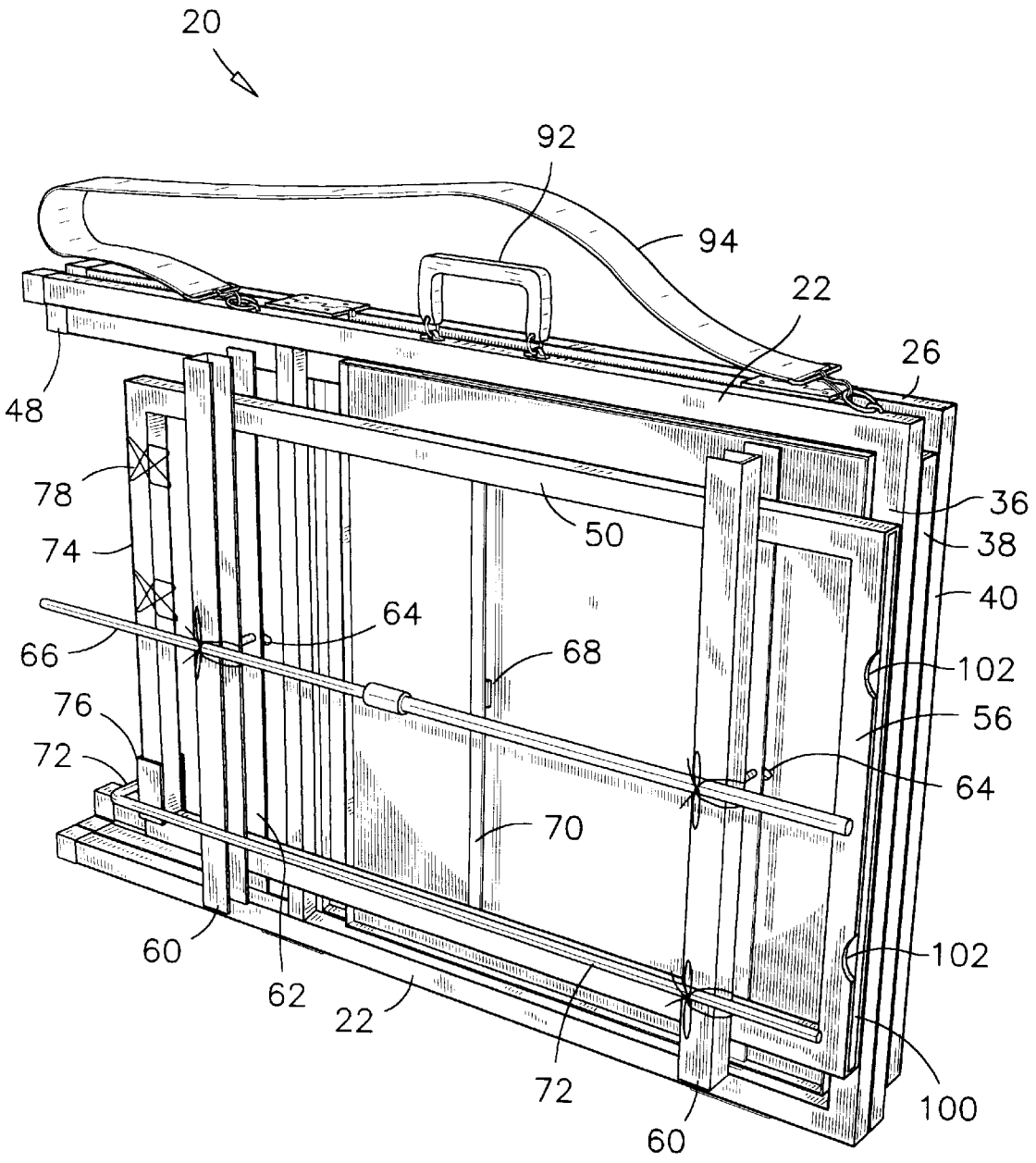
FIG. 5 is a second side perspective view of the easel in a folded mode.

Reference will firstly be made to FIGS. 1 and 2, illustrating the easel 20 according to the preferred embodiment of the invention in its entirety. The preferred easel 20 comprises broadly a U-shaped lower structure comprising a central frame 22 and a pair of lateral left and right frames 24,26 hingedly connected to the central frame 22. In the preferred easel, the central and lateral frames 22,24 and 26, comprise skeletal orthogonal frame members made of structural steel, aluminium, wood or similar structural material. A work support structure 28, also made of structural material is pivotally connected to the upper edge or the central frame 22. The work support structure 28 and both lateral frames 24 and 26 are foldable over the central frame 22 to form a compact arrangement as illustrated in FIGS. 3 and 4, which is conveniently transportable from place to place and easily stowable. In that respect, the easel of the preferred embodiment is stowable is a space of about 6 inches (15 cm) by 20 inches (51 cm) by 31 inches (76 cm).

In the deployed mode, each of frames 22,24 and 26 has a pair of vertical members 30,30', 32,32' and 34,34' respectively, and a horizontal top member 36,38 and 40 respectively. Each of frames 22,24 and 26 further has an intermediate horizontal member 42,44 and 46, which are disposed between a respective pair of vertical members at between 8–10 inches (20–25 cm) from the lower end of the vertical members. The lower end of each vertical member preferably has a plastic or rubber cap 48 for protecting a floor surface when the easel is used indoors for example.

The three frames 22,24 and 26 are movable between a stowable arrangement as shown in FIGS. 3 and 4, into a self-standing U-shaped configuration as illustrated in FIGS. 1 and 2. When the frames are in this later configuration, the lateral frames 24 and 26 may be moved toward or away from each other to avoid obstructions on a terrain, or to satisfy a preference of a right or left-handed user for examples. In that respect, it will be appreciated that a U-shaped configuration that is somewhat open or closed is nevertheless stable and self supportive. It will be appreciated that the lower ends of the vertical members may also have telescoping arrangements to better adapt to irregularities on a terrain.

One of the most important aspects of the structure of each frame in the easel of the preferred embodiment is that the upper horizontal members 36,38 and 40 of the respective frames constitute a series of handrails partly enclosing an aitist's work area. These handrails 36,38,40, are conveniently usable by an artist to brace himself/herself when leaning toward a canvas, when moving from a sitting position on a stool to a standing position, or for periodically resting his/her arms and palette when painting intensively.

Another most important aspect of the easel of the preferred embodiment is the presence of a series of footrests 42,44, and 46 also partly enclosing an artist's work area. These footrests are conveniently usable by an artist to brace himself/herself in a sitting position, or in a standing position to relieve leg fatigue due to standing still during long periods. The U-shaped configuration of these handrails 36,38,40 and footrests 42,44,46 is particularly convenient to satisfy many positional preferences, handedness and movement habits of most artists and to provide a safe working environment in which one can work with less fatigue as compared with the easels of the prior art.

The work support structure 28 is pivotally mounted to the handrail 36 of the central frame 22. The work support structure 28 comprises a rectangular frame 50 and a pair of canvas support members 52,54 that are movably affixed to the rectangular frame. The lower canvas support frame 54 is positioned at a distance from the lower edge 56 of the rectangular frame 50 such that a user can place his/her hand on the lower edge member 56 and such that this member 56 constitutes with the horizontal member 36 a usable handrail affording the mentioned advantages.

Each of the canvas support member 52,54 comprises a channel member 60 for enclosing the top or bottom edge of a canvas, and a flat bar member 62. A flat bar member 62 and a channel member 60 are clamped to each other, on a respective side of the frame 50 and are retained in place relative to the frame 50 by means of a bolt through the flat bar 62 and wing nut assembly 64 which is partly illustrated in FIG. 4. This arrangement is particularly advantageous for adjustment to canvases or sketch pads of various sizes.

The plane of the work support structure 28 is also adjustable to various angles relative to the central frame 22, by means of a telescoping rod 66 which is mountable into a connection 68 affixed to an intermediate bar 70 extending across the rectangular frame 50.

A hand support rod 72 is also provided and is mountable to the upper edge 74 of the work support frame 50 by means of a clip 76 or otherwise. The engagement of the clip 76 to the edge 74 is preferably a releasable U-shaped connection or a similar arrangement such that an artist may place the hand support rod 72 where he/she pleases to work with either hands, or anywhere over a painting for example.

A pair of paper clips 78 is also provided on the upper edge 74 of the work support structure 28 for retaining a photograph, a draft sketch or other visual references used by an artist during a painting session.

The central frame 22 preferably has incorporated therein, a shelf 80 that is foldable from a folded position parallel to the plane of the central frame 22 to a usable horizontal position. In the usable mode, the shelf 80 is set below the handrail 36 and extends across the plane defined by the frame 22. The shelf 80, when deployed, is preferably set at between about 4 inches (10 cm) to about 8 inches (20 cm) below the handrail 36. The shelf 80 preferably extends toward an artist's side of the frame 22 a distance of between about 3 inches (8 cm) and about 6 inches (15 cm) such that painting articles may be placed thereon and are easily accessible without having to reach under the handrail 36. A total area of this shelf 80 is preferably at least as large as a common artist's palette such that an artist using the easel of the preferred embodiment 20 may set down his/her palette thereon once in a while to relax from a painting session or to tend to cleaning a brush, mixing paint or other tasks.

The setting of the shelf 80 is further advantageous for continually supporting a palette during a painting session, whenever an artist prefers to keep one hand free all the time. It will be appreciated from the illustrations of FIGS. 1 and 2 that when a palette is placed on the shelf 80, it is still easily accessible to the artist standing or sitting in the work area defined by the three frames 22,24 and 26.

Other shelves for supporting artist tools and accessories are provided in the lateral panels 24,26. The space defined by each frame 24 or 26 is conveniently used for stowing and supporting foldable shelves that are as large as the space defined by these frames 24,26 can afford. In the preferred embodiment, the lateral right frame 26 comprises a single shelf 82, and the lateral left frame 24 has a pair on superimposed shelves 84,86.

A number of additional features are provided with the easel of the preferred embodiment 20. A J-hook 90 is provided on one of the vertical members of a lateral frame for supporting a roll of paper towel for example. A hook (not shown) is also preferably provided for supporting a trash bag near the J-hook 90 or at other convenient location for receiving and containing used paper towels, especially when the easel 20 is used outdoors for example. A handle 92 and a shoulder strap 94 are mounted on one of the vertical member 30' of the central frame 22 for carrying the easel of the preferred embodiment 20 in a folded mode.

In the easel of the preferred embodiment 20, the lateral right frame 26 is hingedly connected to the vertical member 30', on a pair of spacer blocks 98 affixed to the vertical post 30'. The spacer blocks 98 have a thickness that is similar to the thickness of the structural members of the lateral left frame 24 such that both lateral frames 24,26 are foldable flatly over the central frame 22.

Another notable feature of the easel according to the preferred embodiment is that the rectangular frame 50 of the work support structure 28 is made of hollow structural members and is open along the lower edge thereof. An orthogonal U-shaped insert 100 is telescopically mounted inside the rectangular frame 50, and is extendible when the rectangular frame 50 is laid horizontally, as illustrated in FIG. 3. A pair of thumb notches 102 are provided in the lower edge member 56 of the rectangular frame for pulling the insert 100 out of the rectangular frame 50. This insert 100 is particularly advantageous for selectively defining with the rectangular frame 50 a table-like structure usable by an artist doing water-colour paintings.

While the above description provides a full and complete disclosure of one preferred embodiment of the present invention, various modifications, alternate material, arrangements and equivalents may be employed without departing from the true spirit and scope of the invention. Therefore, the above description and the illustrations should not be construed as limiting the scope of the invention which is defined by the appended claims.

I claim:

1. A foldable easel comprising:

a lower structure comprising an orthogonal central frame having a top member, a lower end and two spaced-apart side members, and orthogonal lateral left and right frames each having an upper portion, lower portion, respective height, width and opposite side edges, one of said side edges on each of said lateral left and right frames being hingedly connected to a respective said side member of said central frame, such that said lateral left and right frames are foldable from a stowable position each being parallel to and laid against said central frame, to a deployed position forming with said central frame a substantially U-shaped configuration, and a work support structure having a work support plane and being hingedly connected to said top member of said central frame and being foldable from a folded position with said work support plane being parallel to and laid against said central frame, to a deployed position with said work support plane extending away from said lower structure, said folded position and said deployed position including a right angle relative to said central frame; said work support structure also having means for supporting an artist canvas in a secured relationship therewith;

said work support structure also comprising a hollow rectangular frame made of hollow structural members, and an orthogonal U-shaped insert telescopically mounted inside said hollow rectangular frame and being extendible relative to said rectangular frame for selectively defining with said rectangular frame a table structure when said work support plane is adapted to be set at about a right angle with said central frame;

such that when said central frame and said lateral left and right frames are adapted to be set in an upright orientation and said lateral left and right frames are adapted to be set in a deployed position, said lower structure is free standing and said U-shaped configuration provides a work environment that is adapted to partly enclose a user thereof and said work support structure is usable in an upright mode and in a table mode.

2. The easel as claimed in claim 1, wherein said central and lateral left and right frames have shelves set therein and said shelves are foldable from a stowed position parallel to a respective said frame to a deployed position normal to said respective said frame.

3. The easel as claimed in claim 1, wherein said lower structure comprises a first handrail along said top member of said central frame.

4. The easel as claimed in claim 3, wherein said lower structure further has second and third handrails respectively extending along said upper portions of said lateral left and right frames.

5. The easel as claimed in 1, wherein said central frame has a first footrest extending between said side members thereof, near said lower end.

6. The easel as claimed in claim 5 wherein said lateral left and right frames have second and third footrests respectively extending between said side edges thereof, near said lower portions.

7. The easel as claimed in claim 6 wherein said footrests are set at a distance of between about 8 inches and about 10 inches from said lower end.

8. The easel as claimed in claim 1, wherein said work support structure comprises a hand support rod removably affixed thereto, and said hand support rod extends therealong and is positional across said means for supporting an artist canvas.

9. The easel as claimed in claim 1, wherein one of said lateral left and right frames has a J-hook affixed thereto for supporting a roll of paper towel.

10. The easel as claimed in claim 1, wherein said means for supporting an artist canvas comprises a channel and a flat bar held at a distance from said channel by a bolt, said channel and said flat bar each being on a respective side of said work support structure.

11. The easel as claimed in claim 1, wherein said work support structure further comprises a telescopic rod connected thereto, and is adjustable at various angles relative to said central frame by working said telescopic rod.

12. An easel comprising:

a lower structure having a top member and support means connected to said top member for supporting said top member above ground;

a work support structure connected to said top member and having means for supporting an artist canvas in a secured relationship therewith; said work support structure being hingedly connected to said top member and being foldable from first position to a second position relative to said top member and including a horizontal position; said work support structure also comprising a hollow rectangular frame made of hollow structural members, and an orthogonal U-shaped insert telescopically mounted inside said hollow rectangular frame and being extendible relative to said hollow rectangular frame when said hollow rectangular frame is adapted to be set horizontally, for selectively defining with said hollow rectangular frame a table structure;

such that said work support structure is usable by an artist for supporting artist work in various positions according to different work requirements.

13. The easel as claimed in claim 12, wherein said rectangular frame has thumb notches therein for assisting in pulling said U-shaped insert therefrom.

14. The easel as claimed in claim 12, wherein said lower structure comprising three orthogonal frames connected to each other edge-to-edge and cooperatively defining a substantially U-shaped work environment.

15. The easel as claimed in claim 14, further comprising a handrail mounted on one of said three orthogonal frames.

16. The easel as claimed in claim 15, wherein said handrail extends along an upper portion of said three orthogonal frames.

17. The easel as claimed in claim 14, wherein each said three orthogonal frames has a footrest extending across a width thereof.

18. The easel as claimed in claim 17, wherein said footrests extend across a plane of each said three orthogonal frames, at a distance of between about 8 inches and about 10 inches from a lower end of each said three orthogonal frames.

19. An easel comprising:

a lower structure comprising three upright orthogonal frames connected to each other edge-to-edge and cooperatively defining a substantially U-shaped work environment; one of said upright orthogonal frames having a top horizontal member;

a work support structure connected to said top horizontal member and having means for supporting an artist canvas in a secured relationship therewith; said work support structure being hingedly connected to said top member and being foldable from first position to a second horizontal position including a horizontal position;

said work support structure also comprising a hollow rectangular frame made of hollow structural members, and an orthogonal U-shaped insert telescopically mounted inside said hollow rectangular frame and being extendible relative to said hollow rectangular frame when said hollow rectangular frame is adapted to be set horizontally, for selectively defining with said hollow rectangular frame a table structure;

each of said three upright orthogonal frames having a handrail mounted on an upper portion thereof and a footrest extending across a width thereof; and each of said three upright orthogonal frames having a shelf mounted therein for supporting artist tools and accessories;

such that a user standing in said U-shaped work environment has access to said handrails, to said footrests, and to said shelves at said user's arm length, whereby said U-shaped work environment is safe and space efficient.

20. The easel as claimed in claim 19, wherein said three upright orthogonal frames comprise a central frame and lateral right and left frames and said shelf in said central frame is set below said handrail a distance of between about 3 inches and about 6 inches, and has a surface area which extends in said U-shaped work environment a distance of between about 4 inches and about 8 inches, relative to said central frame.

* * * * *